United States Patent [19]

Vlasek et al.

[11] Patent Number: 4,641,776

[45] Date of Patent: Feb. 10, 1987

[54] SEGMENTED CONCENTRIC CENTRALIZER

[75] Inventors: David J. Vlasek, Universal City; Harry W. Riddle, San Antonio, both of Tex.

[73] Assignee: Baker Oil Tools, Inc., Orange, Calif.

[21] Appl. No.: 765,798

[22] Filed: Aug. 15, 1985

Related U.S. Application Data

[62] Division of Ser. No. 546,881, Oct. 31, 1983, abandoned.

[51] Int. Cl.[4] ..... B23K 31/02; B21D 41/02

[52] U.S. Cl. ..... 228/155; 72/393

[58] Field of Search ..... 72/393; 228/155

[56] References Cited

U.S. PATENT DOCUMENTS

| | | | |
|---|---|---|---|
| 2,897,016 | 7/1959 | Baker | 308/4 A |
| 3,055,432 | 9/1962 | Park | 308/4 A |
| 3,566,965 | 3/1971 | Solum | 166/241 |
| 3,929,388 | 12/1975 | Sutko et al. | 308/4 A |
| 4,219,081 | 8/1980 | Howe | 166/241 |
| 4,530,231 | 7/1985 | Main | 72/393 |

FOREIGN PATENT DOCUMENTS

| | | | |
|---|---|---|---|
| 636369 | 12/1978 | U.S.S.R. | 308/4 A |

*Primary Examiner*—Kuang Y. Lin
*Assistant Examiner*—Samuel M. Heinrich
*Attorney, Agent, or Firm*—Norvell & Associates

[57] ABSTRACT

A conduit centralizer comprises segmented, sliding upper and lower collars connected by a plurality of axially extending, outwardly bowed leaf springs. Each collar is formed by the hinged connection on a plurality of segments in close fitting contact with the outer diameter of a pipe. The ends of the leaf springs are respectively inserted within the individual segments and welded to the segments. Individual collar segment sections or subassemblies comprising upper and lower collar segments secured to a single intermediate bowed leaf spring can then be interconnected to form a concentric centralizer.

1 Claim, 8 Drawing Figures

SEGMENTED CONCENTRIC CENTRALIZER

CROSS REFERENCE TO RELATED APPLICATION

This application is a divisional application of application Ser. No. 546,881, filed Oct. 31, 1983, entitled "Segmented Concentric Centralizer" now abandoned.

BACKGROUND OF THE INVENTION

1. Field of the Invention

The invention relates to a centralizing device for maintaining a well conduit in a central position with respect to a well bore.

2. Description of the Prior Art

Conduit centralizers, such as casing centralizers, have long been employed with well casings inserted in well bores. The centralizer commonly comprises two axially spaced pairs of collar members which are generally formed from a pair of hinged interconnecting collar segments to permit the rings to be positioned on the casing in snug but slidable relationship thereto. The axially spaced rings are attached to opposite ends of a plurality of outwardly bowed portions of the leaf spring members spaced around the periphery of the collars. The outwardly bowed portions of the leaf springs are proportioned to engage the well bore and to be compressed inwardly by such engagement, thus exerting a centralizing force on the casing to which the centralizer is applied. Normally the centralizer is moved into the well with the casing by a clamping ring which is mounted securely to the exterior of the casing at a position between the two spring connected slidable collars.

Because of the ever increasing depths of modern wells, requiring a large number of casing centralizers to be employed for each well, there has been great emphasis in the well tool industry to minimize the cost of centralizers without in any mannder reducing their effectiveness. It has previously been proposed, for example in U.S. Pat. No. 4,088,186 to Callihan, et al, to fabricate the pivotally interconnected slidable collars from stampings to minimize the manufacturing costs thereof.

In addition to reducing manufacturing costs, it is also necessary to rduce shipping and handling costs and eliminate any unnecessary elements used to fabricate each centralizer. For example, a minimum number of bowed leaf springs necessary to adequately center a pipe should be used to any given application or size.

It is also important that the sliding collars, when assembled, have an internal diameter closely approaching that of a true cylinder, and an internal diameter exceeding the diameter of the casing to which it is to be assembled by only a few thousandths of an inch so that a snug sliding fit of the slidable rings on the casing is achieved. It has not been possible to achieve each of these objectives with the centralizers heretofore utilized in the art.

SUMMARY OF THE INVENTION

Preferably, the invention provides a concentric conduit centralizer wherein each of the axially spaced collar segment sections or subassemblies comprises two collar segments secured to a single outwardly bowed leaf spring and the centralizer is fabricated by the pivotal assemblage of a plurality of collar segment sections. In the preferred embodiment, each segment is formed by stamping operations on a generally rectangular sheet of metal which is double folded to bring the short ends of the rectangular piece into parallel adjacent relationship and thus define two closed loop ends. Prior to the folding operations, a plurality of spaced apertures are formed in the sheet metal piece which traverse the loop areas of the folded piece so as to define spaced hinges. The collar segment sections or subassemblies are identical, and since each segment extends through less than a semicircular arc, the collar segments are flatter than conventional semicircular collar segments and a plurality of collar segment sections with two collar segments secured to a single bowed spring can be nested for storage and shipment.

As an important feature of this invention, the ends of a bowed leaf spring member is then inserted between the two walls of axially spaced collar segments and secured thereto, typically by at least two spot welds, with each weld connecting one of the adjacent ends of a double walled segment to the end of the leaf spring. It is thus assured that each double walled stamped segment is a completely rigid piece.

A further feature of this invention is the employment of a sizing mandrel or fixture to insure that the assembled casing centralizer will snugly but slidably mount on a length of casing. Each casing centralizer collar is assembled around an expandable mandrel and initially defines an internal diameter slighly less than that desired for the final diameter of the slidable segmented rings. The segmented rings are then expanded to a true cylindrical configuration of the precise dimensions desired through expansion of the expandable mandrel.

Further advantages of the invention will be readily apparent to those skilled in the art from the following detailed description, taken in conjunction with the annexed sheets of drawings, on which is shown a preferred embodiment of the invention.

DESCRIPTION OF THE PREFERRED EMBODIMENT

Figure 1:
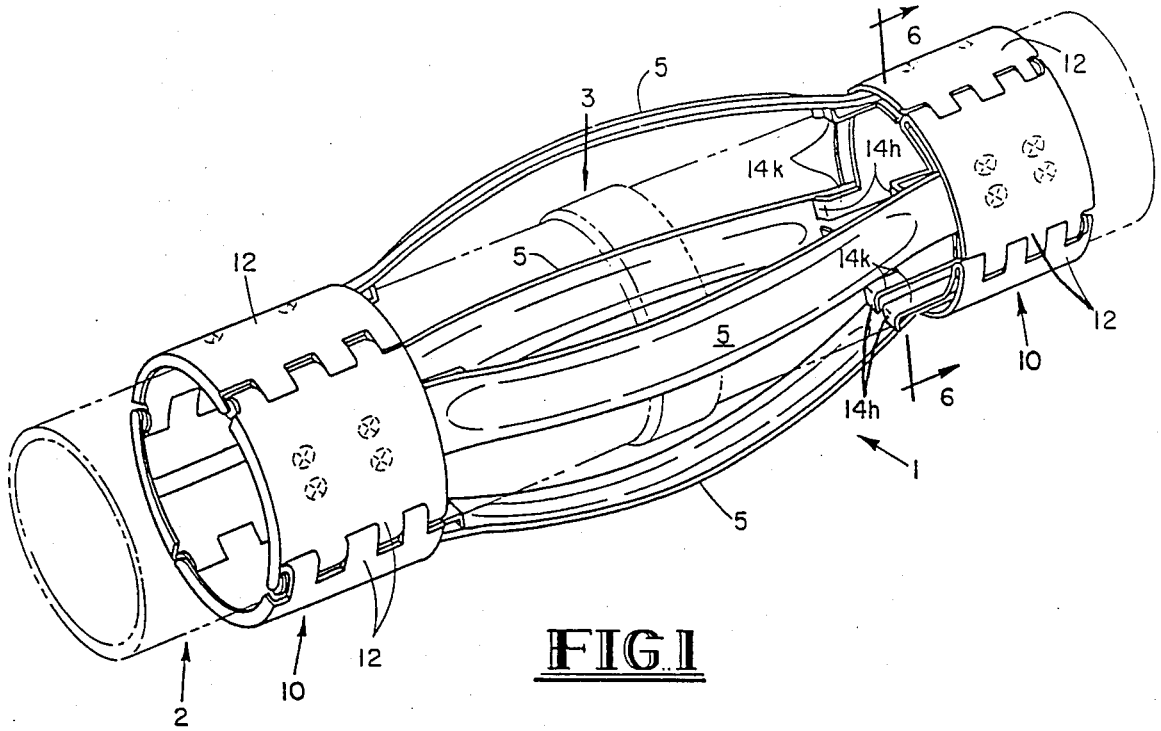
FIG. 1 is a perspective view of a casing centralizer embodying this invention shown in assembled relationship to a length of casing carrying a stop ring for moving the centralizer with the casing.

Referring to FIG. 1, a concentric casing centralizer 1 embodying this invention comprises two identical, slidable collars 10 which are interconnected by a plurality of peripherally spaced, outwardly bowed leaf spring elements 5. Collars 10 are snugly, but slidably, mounted on a length of casing 2. A conventional stop ring 3 is clamped to the casing 2 between the slidable collars 10.

Figure 2:
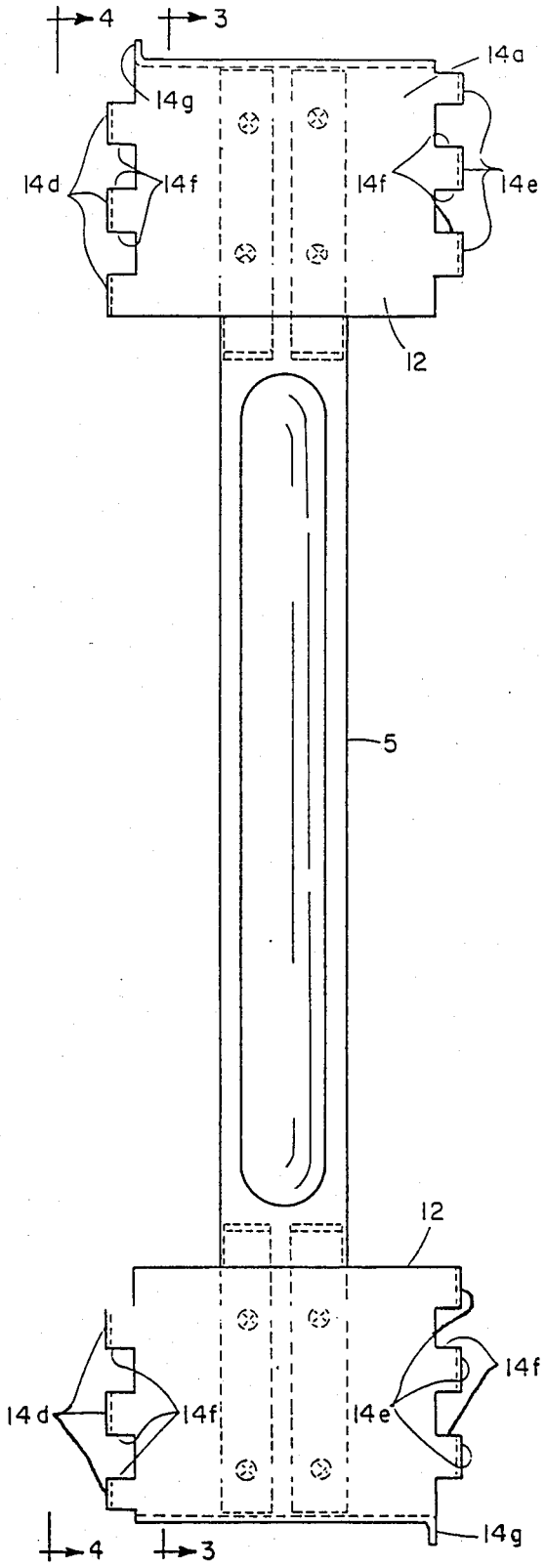
FIG. 2 is a side elevational view of a single segment of the casing centralizer of FIG. 1.
Figure 3:
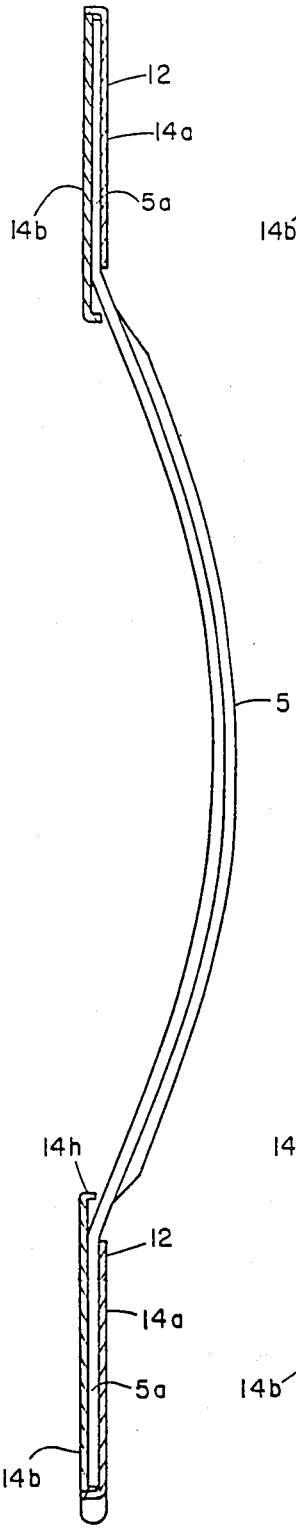
FIG. 3 is a sectional view of FIG. 2 showing the leaf spring element of the casing centralizer in an unstressed condition.
Figure 6:
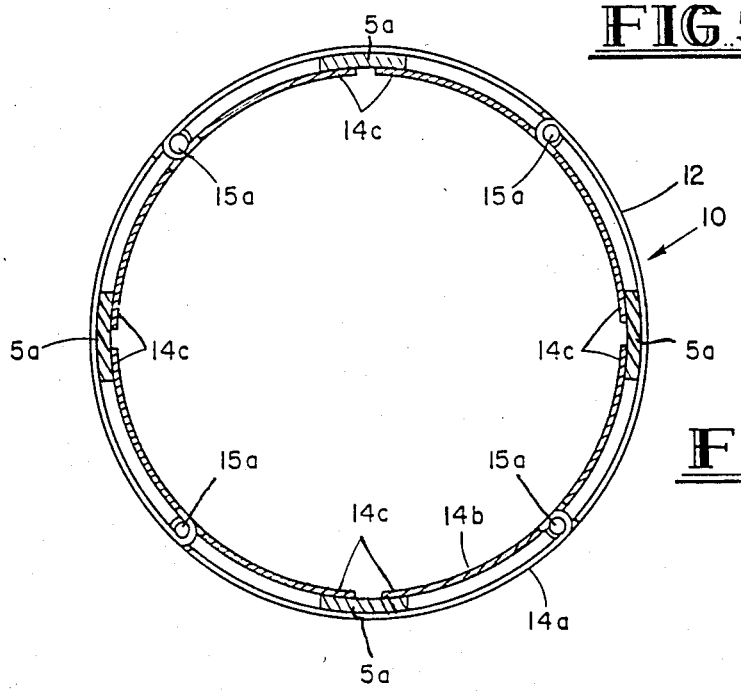
FIG. 6 is a sectional view taken on the plane 6—6 of FIG. 1.
Figure 8:
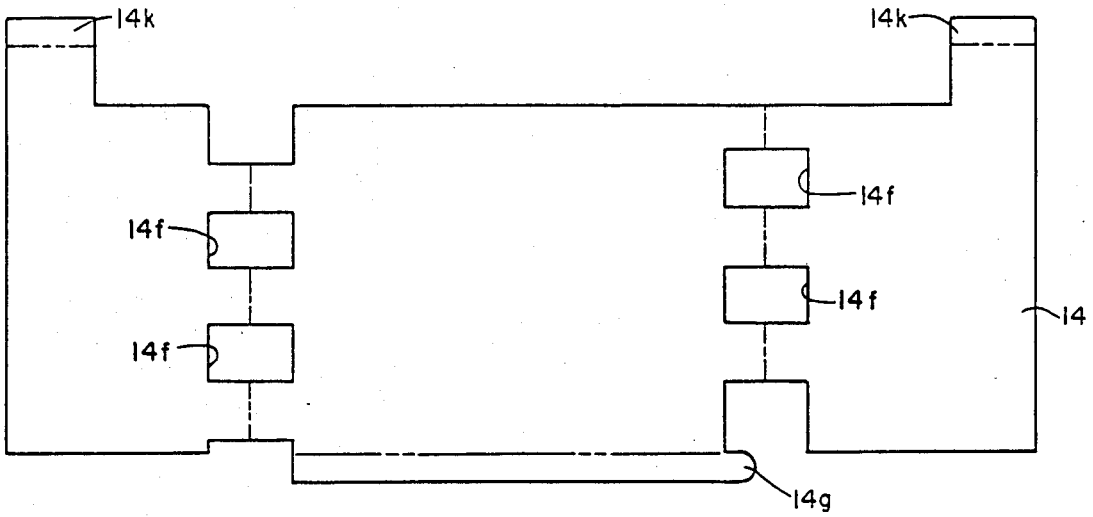
FIG. 8 is a plan view of the blank from which each double walled segment is formed.

Each slidable collar 10 comprises a pivotally interconnected assemblage of a plurality of double walled collar segments 12. As best shown in FIGS. 2, 3 and 6, each collar segment 12 is fabricated by conventional stamping and bending operations on a generally rectangular blank 14 of ferrous metal (FIG. 8). Thus the blank 14 is double folded around a 180° arc to define an outer wall 14*a* and an inner wall 14*b* formed by positioning the two short edges 14*c* of the rectangular blank 14 in parallel, adjacent relationship. The cross-sectional configuration of the double walled collar segment 12 is that of an arcuate segment. The arcutate extent of each collar segment is substantially less than the semicircular extent of conventional two piece hinged collar segments. A plurality of such units are hingedly interconnected so that the internal diameter defined by interconnected segments slightly exceeds that of the casing 2 on which it is to be snugly but slidably assembled.

The sheet metal blank 14 is further provided with a plurality of vertically spaced apertures 14*f* positioned to overlie each folded area of each blank 14 when folded to form the double walled configuration. The apertures 14*f* define a plurality of vertically spaced hinges 14*e* along one side of each double walled segment 14, and 14*d* along the opposite side. Hinges 14*d* and 14*e* are respectively vertically staggered with respect to each other so that they may be assembled in cooperative relationship with an adjoining double walled collar segment 12. Thus, the hinges 14*d* on any one double walled collar segment 12 interengage with the hinges 14*e* on the adjacent segment, and such segments may be securely fastened together by dropping a hinge pin 15 through the aligned openings defined by the interengaged hinges 14*d* and 14*e*. A substantially continuous outer cylindrical surface is thus formed.

Figure 4:
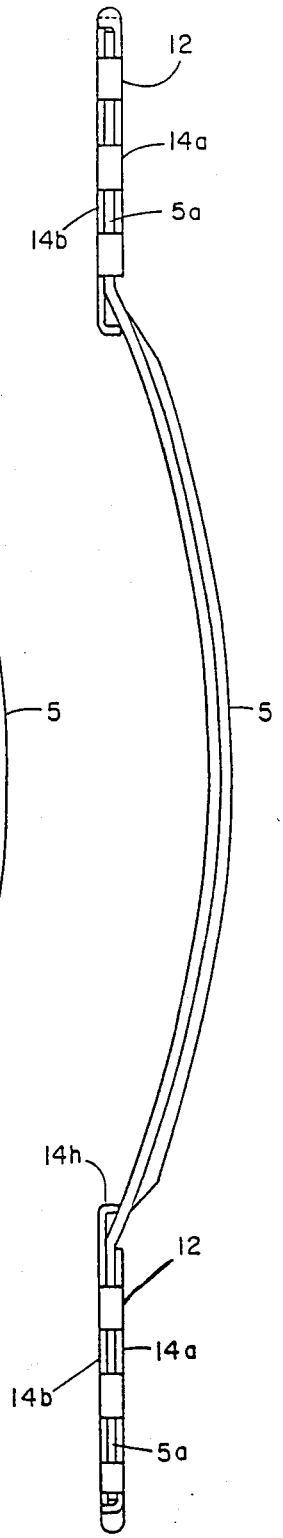
FIG. 4 is an elevational view illustrating the position of the leaf spring element in a stressed position when the centralizer is inserted in a well bore.
Figure 5:
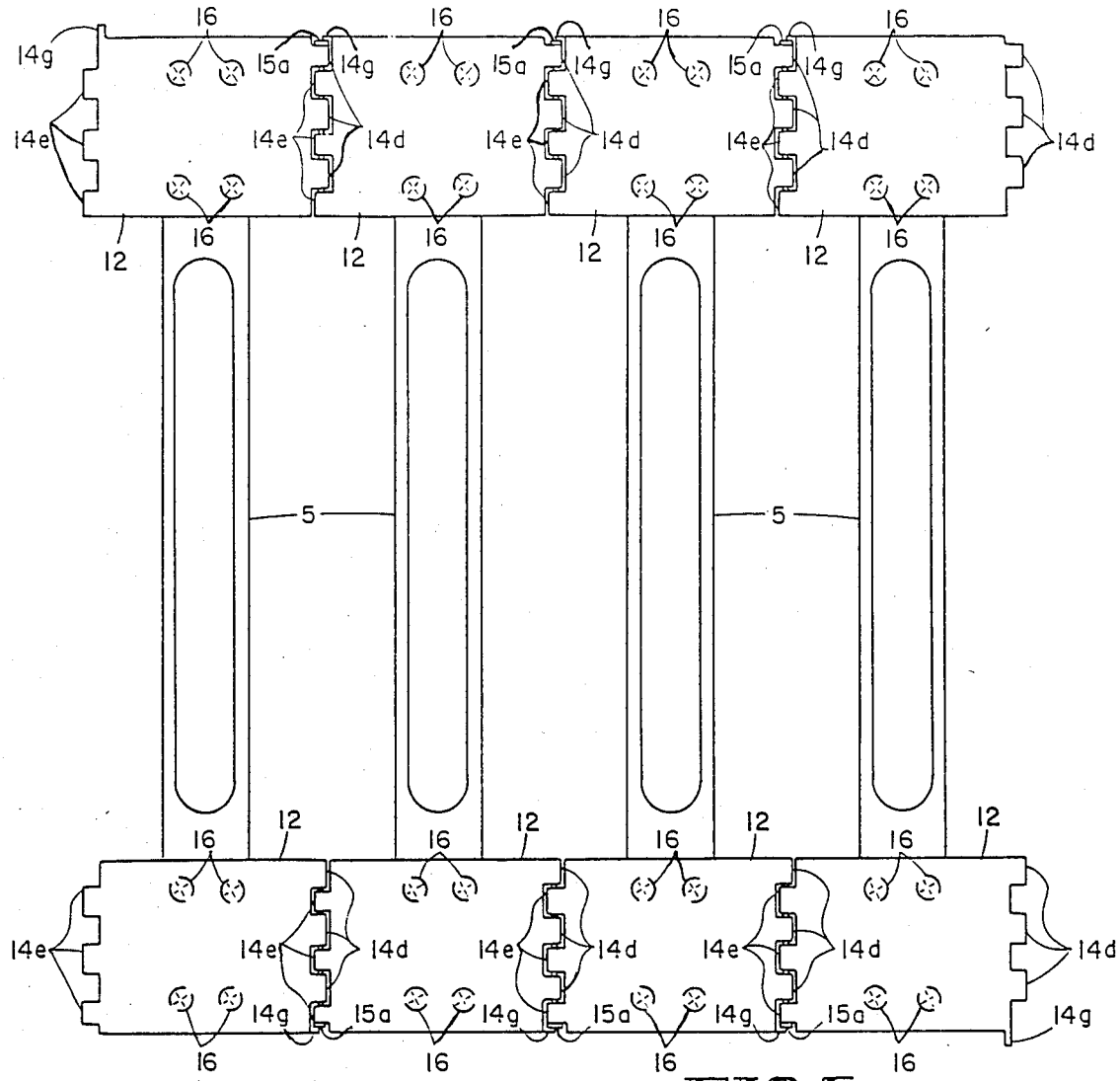
FIG. 5 is an elevational view of a plurality of individual segments of the type shown in FIG. 2 shown in partially assembled relationship prior to wrapping same around a length of casing.

A projecting tab 14*g* is provided on each of the double walled segments 14 in a position to be folded into overlying engagement with the head portion 15*a* of the inserted hinge pin 15. In FIG. 4, the end double walled collar segment 12 has not yet been assembled to another segment, and hence the retaining tab 14*g* is shown in its original position. When assembly of the two end segments 14 is accomplished by dropping a hinge pin 15 through their respective aligned hinge elements 14*d* and 14*e*, the tab 14*g* shown in FIG. 4 will be bent over to assume the same configuration as the other tabs illustrated therein.

As best shown in FIG. 3, the inner wall 14*b* is provided with radially outwardly projecting integral flanges 14*h*. In the unstressed position of the leaf spring 5 (FIG. 3), there is a space between the end of the flanges 14*h* and the respective leaf spring 5. However, as illustrated in FIG. 4, when the leaf spring 5 moves into abutting engagement with the flanges 14*h*, this, in effect, shortens the length of each outwardly bowed spring element 5 and changes its spring constant, making the spring stiffer and more difficult to deflect inwardly. As previously mentioned, this feature permits the easy insertion of each casing centralizer into the well bore but once it is partially inserted, the frictional resistance of the outwardly bowed leaf springs 5 increase as it is fully inserted into the well bore. The radially out-turned flanges 14*h* serve an additional function in that they provide an abutment surface for the respective slidable ring 10 which is engaged by the stop ring 3 which is fixedly secured to the casing 2 in a position intermediate the two segmented slidable collars 10. Thus, limited movement of the casing 2 relative to the slidable collars 10 is permitted until the stop ring 3 strikes the abutment flanges 14*b*, whereupon the centralizer 1 is moved with the casing 2.

Collar segment sections or subassemblies are fabricated by connecting each outwardly bowed leaf spring element 5 at opposite ends to a double walled arcuate collar segment 12. The end portions 5*a* of the outwardly bowed leaf springs 5 are contoured to fit snugly between the walls of the particular double walled segments 12 to which it is connected. Such end portions 5*a* are welded to both the inner walls 14*b* and the outer walls 14*a* of the respective double walled segment 14. A minimum of two welds is employed so that each of the free ends 14*c* of the inner wall 14*b* will be welded to the respective spring end 5*a* and thus each segment 12 will be securely held in its double walled configuration. As illustrated in FIG. 4, four pressure type spot welds 16 are preferably employed with two of the welds securing each of the free edges 14*c* of the double walled segment 14 to the spring end 5*a* and in turn securing the outer wall 14*a* to such spring end 5*a* at four points.

The concentric centralizer 1 is modular and is formed from a plurality of collar segment sections or subassemblies. Each collar segment section comprises a single bowed leaf spring element 15 secured to arcuate collar segments 12 on each end. Since the arcuate extent of each collar segment 12 is substantially less than a semicircle, the identical collar segment sections with attached bowed spring can be nested for storage and shipment and will occupy only slightly more space than the separate bowed spring elements 15 prior to fabrication of the collar segment subassemblies. The complete concentric centralizer 1 is assembled by merely interconnecting the hinges on adjacent collar segments 12. The collar segment sections or subassemblies each containing only one bowed spring 15 are first fabricated, because the centralizing forces exerted on the pipe will be a directed result of the number of springs employed in the centralizer. Only the minimum number of bowed springs necessary will be used to reduce the amount of material used for each centralizer. Thus the number of bowed springs needed for a given size casing will correspond to the number of collar segment assemblies or subassemblies, each containing a single bowed leaf spring, used to fabricate the complete centralizer.

Concentric centralizers for varying size conduit can be provided by using collar segments 12 each having a curvature corresponding to the curvature of the outer surface of the conduit. It is preferred to design the segmented, double walled, slidable collars 10 so that the internal diameters thereof are slightly less than the external diameter of the casing on which the centralizer is to be mounted. This permits the expansion of the internal diameter of the segmented, slidable collars 10 to exactly conform to a cylinder having the desired diametrical clearance with respect to the casing 2 on which it is to be assembled.

Figure 7:
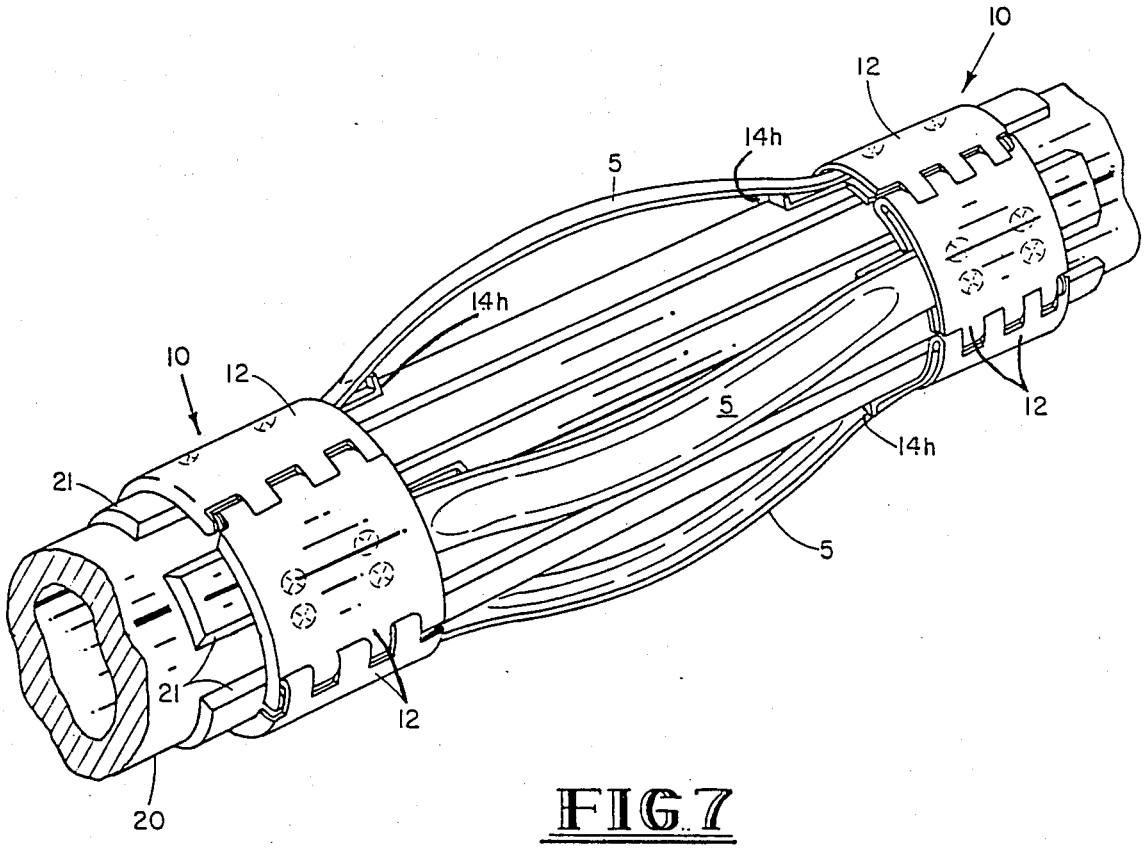
FIG. 7 is a schematic, perspective view illustrating the sizing of the segmented slidable collars of the casing centralizer by an expandable mandrel.

As illustrated in FIG. 7, a conventional expandable mandrel 20 is concurrently inserted through both the sliding collars 10 of the casing centralizer. As shown in FIG. 7, a single expander mandrel is used to expand both the upper and lower collars. Of course the two collars can be separately expanded using a single fixture. Expander mandrel 20 has conventional expanding elements 21 (shown only schematically) which can be actuated to move radially outwardly and thus concurrently expand the internal diameter of both the upper and lower segmented rings to exactly conform to a cylindrical shape of the desired diameter to insure a snug, slidable fit with the casing. By using the expander mandrel to assemble the concentric centralizers 1, centralizer segments 12 having a specific width can be used on conduits of different sizes. The expander mandrel or an equivalent expanding fixture is used to adjust the curvature of each centralizer segment 12 to correspond to the curvature of the conduit. In order to insure that the minimum number of bowed springs 15 are utilized for each size, however, the preferred embodiment of this invention does not employ an identical centralizer collar segment 12 for all conduit sizes. A single size collar segment can, however, be used on more than one size of conduit thus reducing the total inventory of collar segments 12 and centralizer collar segment sections or subassemblies needed for casing of all sizes.

Those skilled in the art will recognize that the aforedescribed construction provides a centralizer of unusual rigidity and accuracy, yet utilizing a minimum of metal and is fabricated with no expensive machining operations. Moreover, the assembly of the unit in the field is accomplished with simple tools and the assembly operation can in no manner disturb the accuracy fo the diametrical dimensions of the sliding rings of the centralizer.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of manufacture of a well conduit centralizer comprising first and second axially spaced collars extending around the well conduit and a plurality of axially extending bowed springs respectively attached at each axial end to the first and second collars, comprising the steps of:

(1) stamping a plurality of segments from a rectangular sheet to form an arcuate double walled configuration having hinge loops on each end of each segment pivotally interconnectable to form a continuous ring having an internal cylindrical surface of a diameter less than the external diameter of the well conduit;

(2) inserting the ends of each bowed spring between the walls of said double walled segment and welding each inserted end to both walls of the respective double walled segment;

(3) pivotally interconnecting all segments at each end of the bowed springs by inserting pins through said hinge loops to form said first and second axially spaced collars; and (4) inserting an expandable mandrel within said collars and expanding the entire peripheral length of each collar to an internal diameter greater than the well conduit external diameter to provide a concentric, slidable fit of said collars upon the well conduit.

* * * * *